US010995940B2

(12) United States Patent
Kaye et al.

(10) Patent No.: US 10,995,940 B2
(45) Date of Patent: May 4, 2021

(54) DETACHABLE DUAL-MODE LIGHTING DEVICE AND ASSOCIATED HEADLAMP SYSTEM

(71) Applicant: LB Marketing, Inc., Alpharetta, GA (US)

(72) Inventors: Douglas R. Kaye, Alpharetta, GA (US); Kevin Joseph Brown, Alpharetta, GA (US); Elvis Perez, Alpharetta, GA (US)

(73) Assignee: LB MARKETING, INC., Alpharetta, GA (US)

( * ) Notice: Subject to any disclaimer, the term of this patent is extended or adjusted under 35 U.S.C. 154(b) by 0 days.

(21) Appl. No.: 16/864,211

(22) Filed: May 1, 2020

(65) Prior Publication Data

US 2020/0355353 A1 Nov. 12, 2020

Related U.S. Application Data

(60) Provisional application No. 62/843,608, filed on May 6, 2019.

(51) Int. Cl.
*F21V 21/084* (2006.01)
*F21V 17/00* (2006.01)
(Continued)

(52) U.S. Cl.
CPC ..... *F21V 21/084* (2013.01); *F21V 17/007* (2013.01); *F21L 4/00* (2013.01); *F21Y 2115/10* (2016.08)

(58) Field of Classification Search
CPC ..... F21L 4/00; F21L 4/005; F21L 4/04; F21L 4/045; F21S 9/02; F21V 14/06;
(Continued)

(56) References Cited

U.S. PATENT DOCUMENTS 3,601,595 A 8/1971 Kivela
4,462,064 A 7/1984 Schweitzer
(Continued)

FOREIGN PATENT DOCUMENTS

CN 102192465 A 9/2011
GB 2538939 A 12/2016

OTHER PUBLICATIONS

Amazon.com, "Dorcy Pro Series 200-Lumen Weather Resistant LED Magnetic Headlight," https://www.amazon.com/Dorcy-200-Lumen-Resistant-Headlight-41-2614/dp/B00YCKX7TK (last visited: Aug. 13, 2018).
(Continued)

*Primary Examiner* — Zheng Song
(74) *Attorney, Agent, or Firm* — Thomas | Horstemeyer, LLP

(57) ABSTRACT

Disclosed are various embodiments for a lighting device that can include be removably attached to a head guard to form a headlamp system, or other dock. The lighting device includes a battery, a light emitting element, and a lighting device body comprising an inner sleeve and an outer sleeve. The outer sleeve is adapted to slide relative to the inner sleeve along the light device body to toggle the lighting device between (a) an area light mode of operation where light of the light emitting element emits from sides of the lighting device body, and (b) a flashlight mode of operation where light of the light emitting element emits only from a front of the lighting device.

20 Claims, 12 Drawing Sheets

(51) Int. Cl.
*F21Y 115/10* (2016.01)
*F21L 4/00* (2006.01)

(58) Field of Classification Search
CPC ..... F21V 14/065; F21V 14/08; F21V 14/085; F21V 19/0025; F21V 19/004; F21V 17/007; F21V 21/084; F21V 33/0004; F21W 2121/06
See application file for complete search history.

(56) References Cited

U.S. PATENT DOCUMENTS 4,916,596 A 4/1990 Sharrah et al.
5,001,612 A * 3/1991 Odium ..... F21L 15/02 362/186
6,575,587 B2 6/2003 Cramer et al.
6,598,993 B1 * 7/2003 Dalton ..... F21V 14/045 362/202
7,281,826 B2 10/2007 Huang
7,473,007 B1 * 1/2009 Wang ..... F21V 14/085 362/187
7,549,770 B2 6/2009 Devaney et al.
7,635,195 B2 12/2009 Tarter
3,038,311 A1 10/2011 Lau
8,113,681 B2 2/2012 Dallas et al.
8,474,995 B2 7/2013 Lau
8,545,040 B2 10/2013 Berken
8,545,069 B2 10/2013 McCaslin et al.
8,662,699 B2 3/2014 Tarter
9,080,730 B2 7/2015 Popper et al.
9,163,793 B2 10/2015 Popper et al.
9,228,704 B2 * 1/2016 Andersen ..... H01R 13/6205
9,568,171 B1 * 2/2017 Grider ..... F21L 4/08
9,927,077 B1 * 3/2018 Fowkes ..... F21L 13/00
10,091,854 B1 10/2018 Brandon, II
10,215,383 B2 2/2019 Grider et al.
2001/0024367 A1 * 9/2001 Shiau ..... F21L 15/02 362/188
2005/0174753 A1 8/2005 Cao et al.
2008/0117623 A1 * 5/2008 Tarter ..... F21L 4/04 362/106
2008/0180946 A1 * 7/2008 Kim ..... F21V 21/0965 362/205
2008/0253109 A1 10/2008 Canino et al.
2008/0298048 A1 12/2008 Garrity et al.
2009/0052181 A1 2/2009 Mao
2010/0053942 A1 3/2010 Tarter et al.
2011/0063826 A1 * 3/2011 Lau ..... F21L 4/027 362/190
2012/0008309 A1 1/2012 Hale
2013/0250593 A1 * 9/2013 Popper ..... F21L 15/14 362/476
2013/0301254 A1 * 11/2013 Popper ..... F21V 14/025 362/188
2013/0335954 A1 * 12/2013 Sharrah ..... F21V 21/0808 362/183
2015/0285447 A1 10/2015 Inskeep
2017/0211759 A1 7/2017 Qiu
2017/0284646 A1 10/2017 Arena et al.
2018/0187869 A1 7/2018 Wiegel et al.
2018/0231234 A1 8/2018 Bian
2020/0109841 A1 * 4/2020 Cacciabeve ..... F21L 4/08

OTHER PUBLICATIONS

Amazon.com, "NICRON Standalone Detachable Headlamp Flashlight," https://www.amazon.com/Flashlight-Standalone-Detachable-Rechargeable-flashlight/dp/B078NRW8PV (Publication Date Unknown) (last visited: May 8, 2020).
Amazon.com, "Remington High-performance 3AAA-size, 2-in-1 LED Flashlight," https://www.amazon.com/Remington-High-performance-3AAA-size-LED-Flashlight/dp/B001KYFZGO/ (Publication Date Unknown) (last visited: May 8, 2020).
Radiant 200 Collapsible Lantern+Flashlight https://www.niteize.com/product/Radiant-200-Collapsible-Lantern-Flashlight.asp (Publication Date Unknown) (last visited: May 8, 2020).

* cited by examiner

DETACHABLE DUAL-MODE LIGHTING DEVICE AND ASSOCIATED HEADLAMP SYSTEM

CROSS-REFERENCE TO RELATED APPLICATION

This application claims the benefit of and priority to U.S. Provisional Patent Application No. 62/843,608 entitled "DETACHABLE DUAL-MODE LIGHTING DEVICE," filed May 6, 2019, the contents of which being incorporated by reference in their entirety herein.

BACKGROUND

Several forms of hand-free lighting exist. For instance, lighting devices are often found mounted on helmets or headbands, which prove useful in law enforcement, mining, construction, automotive, manufacturing, or other industries that frequently require hand-free lighting solutions. Existing lighting devices, however, generally include a lighting element that is fixed and not removable from a helmet, headband, or other device. Some removable lighting devices exist; however, these lighting devices are not suitable for hands-free operation and are often not easily removable or attachable to a helmet, headband, or other device. The modes of operation of these lighting devices are also limited, impairing use of these lighting devices in various situations.

FIELD OF THE INVENTION

The present invention relates to a portable lighting device. More specifically, the present invention relates to a lighting device that can be removably attached to a head guard or other suitable dock, where the lighting device can be toggled between a lantern and a flashlight.

BRIEF DESCRIPTION OF THE DRAWINGS

Many aspects of the present disclosure can be better understood with reference to the following drawings. The components in the drawings are not necessarily to scale, emphasis instead being placed upon clearly illustrating the principles of the disclosure. Moreover, in the drawings, like reference numerals designate corresponding parts throughout the several views.

DETAILED DESCRIPTION

Figure 1:
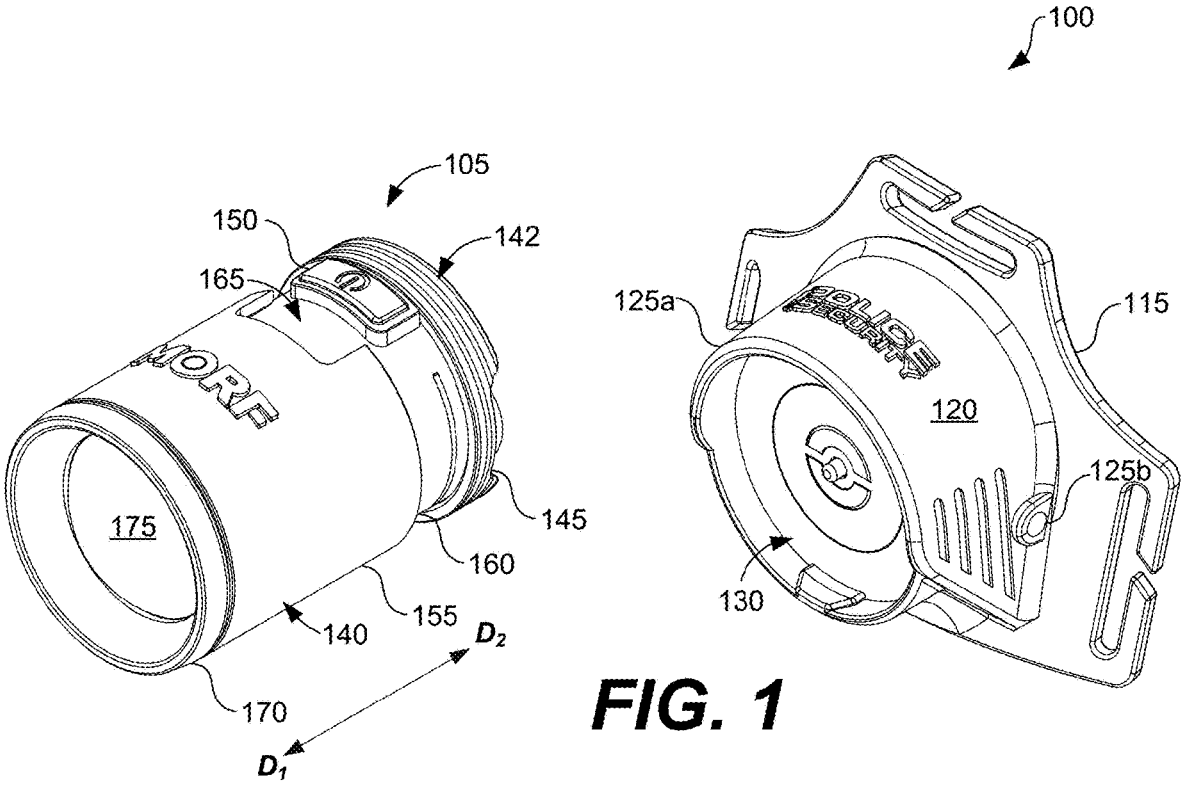
FIG. 1 is a top perspective view of a lighting system having a head guard with a dual-mode lighting device in accordance with various embodiments of the present disclosure.

The present disclosure relates to a lighting system comprising a lighting device that can be removably attached to a head guard of a headlamp system, or other suitable dock. The lighting device of the lighting system is configured to be mechanically toggled between different modes of operation. For instance, the lighting device can be configured to toggle between a flashlight and an area light, such as a lantern, based on a sliding of an outer sleeve of the lighting device, as will be described.

Existing hand-free illumination devices generally include a fixed lighting element that is not removable from a helmet or headband. While some devices include a removable lighting element, generally, these devices are not optimal for hand-free illumination. For instance, the removal and reattachment of lighting elements in existing products is time and labor intensive. Additionally, these lighting elements generally are not rechargeable and require fixed electrical connections. Providing a detachable and rechargeable lighting element that can be easily removed, attached, and secured to a helmet, headband, or other head-mounted device can present significant technical challenges.

Accordingly, in various embodiments described herein, a lighting system is described that includes a head guard or other dock, and alighting device configured to detachably attach to the head guard or other dock. The lighting device includes a battery, a light emitting element, and a lighting device body comprising an inner sleeve and an outer sleeve. The outer sleeve is adapted to slide relative to the inner sleeve along the light device body to toggle the lighting device between an area light mode of operation where light of the light emitting element emits from sides of the lighting device body, and a flashlight mode of operation where light of the light emitting element emits only from a front of the lighting device.

Further, the head guard may include at least one magnet and at least one electrical contact, the lighting device may include at least one magnet and at least one electrical contact, and the lighting device may be sized and positioned such that, when removably attached to the head guard, the at least one magnet of the lighting device magnetically couples to the at least one magnet of the head guard and the at least one electrical contact of the lighting device electrically couples to the at least one electrical contact of the head guard.

In some embodiments, the outer sleeve is at least partially transparent and the inner sleeve is opaque. The lighting device includes a light cup secured to the outer sleeve such that the light cup slides with the outer sleeve relative to the inner sleeve. When the lighting device is toggled to the area light mode of operation, the light cup is in a first position that causes the light of the light emitting element to emit through sides of the outer sleeve. When the lighting device is toggled to the flashlight mode of operation, the light cup is in a second position that causes the light of the light emitting element to emit through only the front of the lighting device.

The head guard may include a receiver cavity, a presence sensor positioned within the receiver cavity, a housing light emitting element, and processing circuitry. The processing circuitry may be configured to turn on the housing light emitting element when the lighting device is removed from the receiver cavity and turn off the housing light emitting element when the lighting device is positioned in the receiver cavity.

The lighting device body may further include a lighting device base comprising a first recess positioned on a first side of the lighting device base and a second recess positioned on a second side of the lighting device base, a first hook pivotably coupled to the lighting device base such that a pivot of the first hook nests the first hook in the first recess or retracts the first hook from the first recess, and a second hook pivotably coupled to the lighting device base such that a pivot of the second hook nests the second hook in the second recess or retracts the second hook from the second recess. The first recess, the second recess, the first hook, and the second hook are semi-circular shaped according to some embodiments.

The lighting device may further include a switch and processing circuitry that is configured to toggle the lighting element disposed within the housing between a plurality of modes of illumination in response to a manipulation of the switch.

The battery of the lighting device may be rechargeable and the head guard may include processing circuitry configured to, in response to the lighting device being electrically coupled to the head guard, recharge the battery of the lighting device.

Further, the head guard may include a receiver cavity and the lighting device may include a lighting device base of a shape and size similar to the receiver cavity such that the lighting device forms an interference fit with the receiver cavity.

The outer sleeve of the lighting device body may include an aperture. The lighting device may include a switch projecting from the inner sleeve of the lighting device body, the aperture and the switch having a similar size and shape. When the lighting device is toggled to the flashlight mode of operation, the switch is nested within the aperture.

A method is described that includes providing a dock, where the dock comprises a head guard. The method further includes providing a light emitting device detachably attachable to the head guard. The light emitting device includes a battery, a light emitting element, and a lighting device body comprising an inner sleeve and an outer sleeve, where the outer sleeve is adapted to slide relative to the inner sleeve along the light device body to toggle the lighting device between an area light mode of operation where light of the light emitting element emits from sides of the lighting device body, and a flashlight mode of operation where light of the light emitting element emits only from a front of the lighting device.

Turning now to the drawings, FIG. 1 shows a non-limiting example of a lighting system 100 in accordance with various embodiments described herein. The lighting system 100 may include a headlamp system or similar lighting system as can be appreciated. Accordingly, the lighting system 100 can include a lighting device 105 and a head guard 110, where the lighting device 105 is detachably attached or, in other words, removably attached to the head guard 110. While only the lighting device 105 and the head guard 110 are shown in the various figures, it is understood that the lighting system 100 may further include additional components known in the field of headlamps, such as straps, power supplies, electrical wires, power adaptors, batteries, etc., which are not shown for explanatory purposes.

Referring first to the head guard 110, the head guard 110 can include a head guard plate 115, a receiver housing 120, pivoting knobs 125*a*, 125*b* (collectively "pivoting knobs 125"), as well as other components as will be described. The head guard plate 115 may be integral with the head guard 110 meaning the head guard 110 is a single main piece, which may be formed of plastic or other suitable material. Generally, the head guard 110 is adapted to be worn on a head of an operator. For instance, the head guard plate 115 can be positioned on a forehead of an individual or on the front of a helmet, such as a construction helmet, skateboarding helmet, or other helmet. Thus, the head guard plate 115 can be ergonomically countered to fit on or near a forehead of an individual or a helmet. As such, the head guard 110 can provide an operator with a hands-free source of lighting for various uses. While the embodiment of FIG. 1 includes pivoting knobs 125, it is understood that the pivoting knobs 125 are an optional feature in various embodiments. For instance, the location of the pivoting knobs 125 may be instead used as a location where a wire enters the head guard 110 to couple to processing circuitry disposed therein.

However, in some situations, it is beneficial to have a hand-held source of light. For instance, a hand-held flashlight can provide a better source of light in hard-to-reach places or in various cavities and workspaces. Also, in some scenarios, it may be desirable to provide an area light, for instance, when illuminating a tent while camping, lighting up a workspace, or other use. Accordingly, the lighting device 105 can be detached or removed from the head guard 110 such that the lighting device 105 can be operated as a hand-held source of light similar to a flashlight or a lantern, as will be described.

In some embodiments, the head guard 110 includes a receiver cavity 130 in which the lighting device 105 can be positioned and retained when connected to the head guard 110. More specifically, a base of the lighting device 105 can be positioned in the receiver cavity 130 such that the base of the lighting device 105 is situated and retained therein through a slight interference or friction fit, also in addition to or in place of a magnetic coupling as will be discussed.

Figure 4:
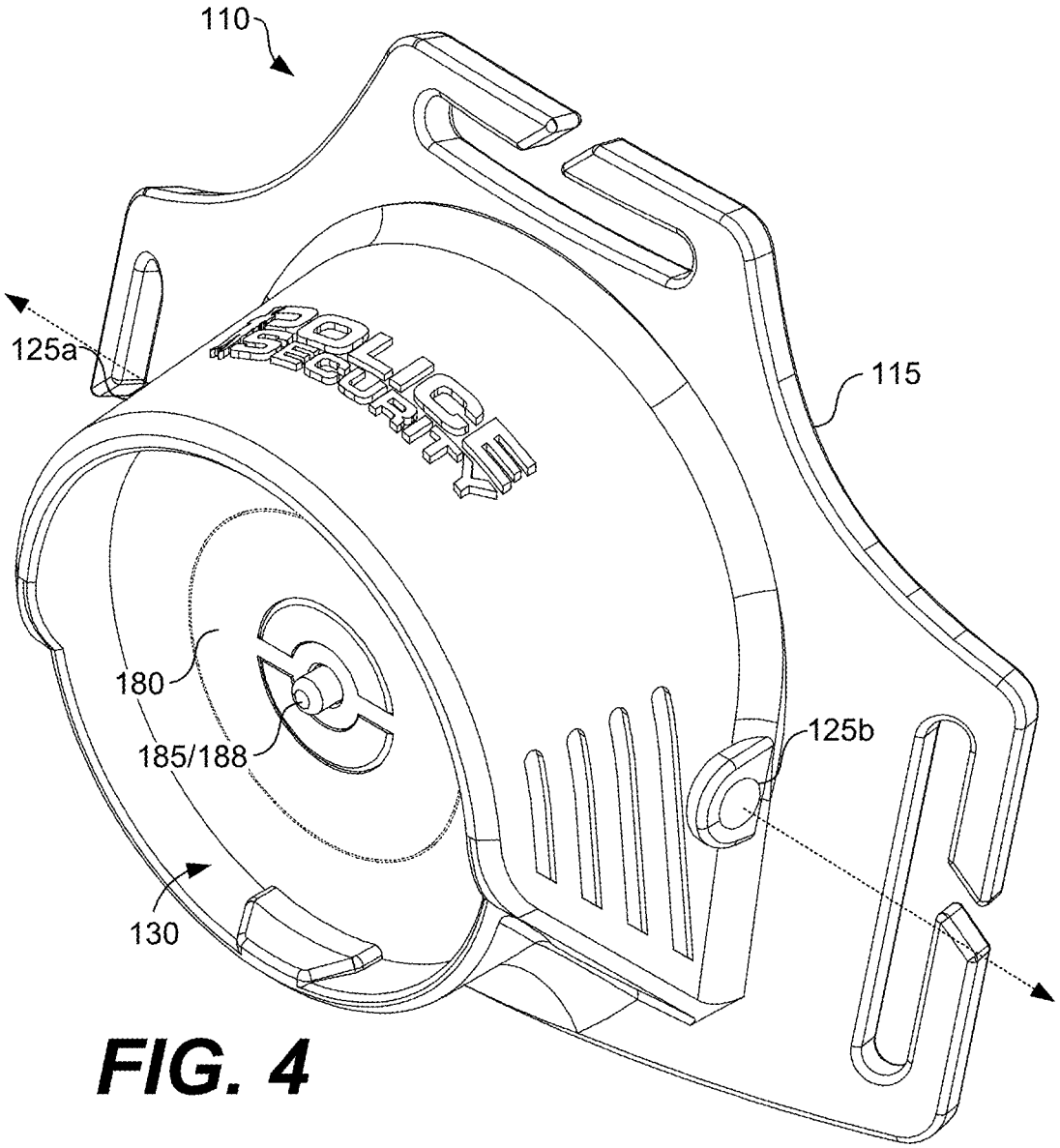
FIG. 4 is a top perspective view of the head guard of FIG. 1 in accordance with various embodiments of the present disclosure.

To form a slight interference or friction fit, the receiver housing 120 can be sized and positioned to define a receiver cavity 130 having a shape that substantially conforms to a shape of the base of the lighting device 105. In some embodiments, the receiver housing 120 includes a circular projecting portion with a prominent projecting top portion (projecting beyond other portions of the circular projection portion), also referred to as an overhang, that acts as a sleeve in which the lighting device 105 may be nested or otherwise positioned. Additionally, assuming the base of the lighting device 105 includes a generally circular body, the receiver housing 120 and the receiver cavity 130 can also include a generally circular body, as shown in FIG. 1 and FIG. 4. However, the base of the lighting device 105 and the receiver cavity 130 can assume other shapes, as can be appreciated.

In further embodiments, however, the lighting device 105 may detachably attach to the head guard 110 without use of a receiver cavity 130. For instance, the lighting device 105 may couple to the head guard 110 using only a magnetic connection without nesting in a cavity or similar component. Also, in further embodiments, the lighting device 105, as opposed to the head guard 110, may include a cavity (not shown) positioned on a rear of the device, whereas the head guard 110 includes a projecting portion that correspondingly nests within the cavity of the lighting device 105.

To facilitate the removability and independent operation of the lighting device 105, the lighting device 105 may include a light source and a power source. For instance, in some embodiments, the lighting device 105 may include one or more batteries that permit the lighting device 105 to power one or more light sources, such as one or more light emitting diodes (LEDs), where the power source is independent of a power supply or other light source of the lighting system 100.

Figure 2:
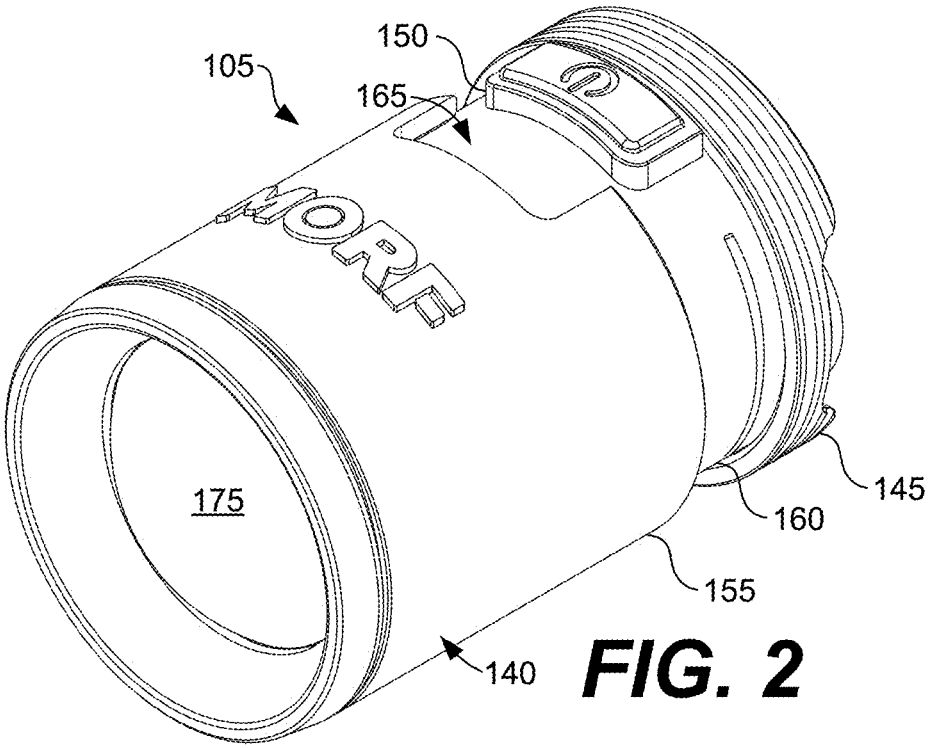
FIG. 2 is a top perspective view of the dual-mode lighting device of FIG. 1 in a second, extended state in accordance with various embodiments of the present disclosure.
Figure 3:
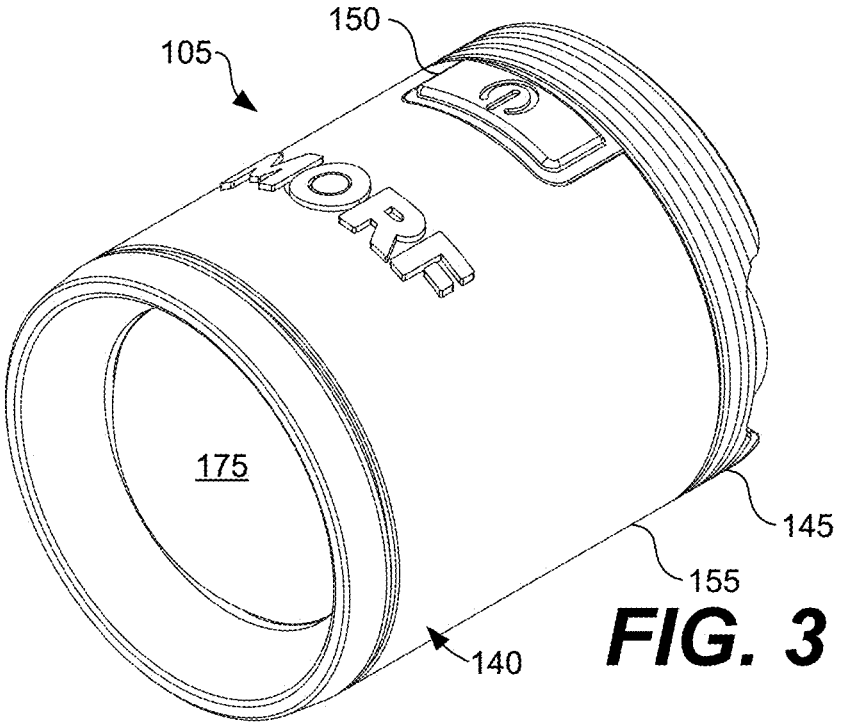
FIG. 3 is a top perspective view of the dual-mode lighting device of FIG. 1 in a first, closed state in accordance with various embodiments of the present disclosure.

The lighting device 105 includes a lighting device body 140. In some embodiments, the lighting device body 140 can include a longitudinally extending and substantially tubular body, as shown in FIGS. 1, 2, and 3. Further, the lighting device body 140 can include one or more recessed or projecting ridges 142 in various regions of the lighting device body 140 that facilitate gripping the lighting device 105. For instance, the ridges 142 may be positioned on the light device base 145 or other suitable portion of the lighting device body 140. The lighting device body 140 can further include a lighting device base 145 which can be nested, housed, or otherwise positioned in the receiver housing 120, for instance, when the head guard 110 is used as a hands-free source of light.

In some embodiments, the lighting device base 145 of the lighting device 105 includes male threads that correspondingly engage with a female threads (not shown) that are positioned in the receiver housing 120, or vice versa. For instance, the lighting device 105 may be positioned in the receiver housing 120 and rotated by the operator to form a threaded connection or other similar mechanical connection between the lighting device 105 and the head guard 110. In other embodiments, the lighting device base 145 of the lighting device 105 include female threads that engage with a male threads (not shown) positioned in the receiver housing 120. The threaded connection formed between the lighting device 105 and the head guard 110 may be in place of or in addition to a magnetic connection, as will be described.

The lighting device 105 may further include a switch 150 and processing circuitry (not shown). The processing circuitry can include a printed circuit board (PCB), an integrated circuit (IC) or a microcontroller having firmware or software installed thereon, in some examples. Through operation of the processing circuitry, the switch 150 can toggle the light source and/or mode of operation of the lighting device 105. For instance, in some embodiments, the switch 150 can be manipulated by the operator to turn the light source on or off. In addition to or in lieu of toggling the light source, the switch 150 can be manipulated to iterate through different modes of illumination or operation. The different modes of illumination or operation can include, for example, pulsating the light source (e.g., performing a strobe effect), providing a constant light source typical to a flashlight, varying the color of the light source, varying the luminous intensity of the light source, simply turning the light on or off, or other operation as can be appreciated.

The lighting device body 140 may include an outer sleeve 155 and an inner sleeve 160. The outer sleeve 155 is adapted to telescope relative to the inner sleeve 160. In other words, the outer sleeve 155 may be slidably coupled to the inner sleeve 160 and/or the lighting device body 140. More specifically, with the inner sleeve 160 in a constant position, the outer sleeve 155 may be configured to slide in two opposing directions $D_1$, $D_2$ to toggle the lighting device 105 between different states and/or modes of operation. For instance, the outer sleeve 155 may be adapted to slide in a first direction $D_1$ to toggle the lighting device 105 to an area light where light is emitted from a central region or sides of the lighting device body 140, as shown in FIG. 2 (e.g., a second state and/or an extended state), or slide in a second direction $D_2$ to toggle the lighting device 105 to a flashlight where light is emitted only from a front of the lighting device 105, as shown in FIG. 3 (e.g., a first state and/or a closed state).

As such, the outer sleeve 155 may be described as having a telescoping relationship with respect to the inner sleeve 160 and/or the lighting device body 140. For instance, the embodiment of FIG. 1 shows the lighting device 105 in the second state where the outer sleeve 155 is fully extended from the lighting device base 145 such that light can be emitted from a central region or sides of the lighting device 105. Accordingly, the lighting device 105 can act as an area light or a lantern.

The switch 150 may project from the lighting device body 140 or, more specifically, the switch 150 may project from a surface of the inner sleeve 160. As shown in FIG. 2, the outer sleeve 155 that slides relative to the inner sleeve 160 may include an aperture 165 formed integral with the outer sleeve 155, where the aperture 160 has a size and position such that, when the inner sleeve 160 is fully nested within the outer sleeve 155, the switch 150 is nested within the aperture 165 of the outer sleeve 155, as shown in FIG. 3.

Additionally, the lighting device 105 may include a bezel 170, a lens 175, a reflector (not shown), a lighting element (also referred to as a light source), a power source (e.g., a rechargeable battery), as well as other components typical to a flashlight or lantern not described herein. The lens 175 may include a partially or fully transparent lens 175 such that light can be emitted therethrough, for instance, when the lighting device 105 is toggled to the flashlight mode of operation. In some embodiments, the bezel 170 can include a circumference equal to or greater than that of the lighting device body 140, as shown in FIG. 1. Further, the light source can include one or more light bulbs or LEDs in some embodiments.

The rear side of the lighting device body 140 may include at least one contact pad adapted to magnetically couple and/or electrically couple the lighting device 105 to the head guard 110 or other dock (e.g., a bicycle dock, a tent dock, etc.) to be powered directly by a power supply of the head guard 110 or other dock or to be recharged by the power supply, as will be described. Further, in some embodiments, the lighting device 105 can be sized and positioned such that, when situated in the receiver cavity 130, a magnet of the lighting device 105 magnetically couples a magnet of the head guard 110, thereby causing one or more electrical contacts of the lighting device 105 to align with and electrically couple to one or more electrical contacts of the head guard 110. The magnet of the head guard 110 can include a magnetic metal plate or, alternatively, the magnet of the lighting device 105 can include a magnetic metal plate in some embodiments.

In further embodiments, the lighting device 105 can include a first battery while the head guard 110 includes a power supply housing having a second battery. The head guard 110 can include processing circuitry electrically coupled to the second battery, where the processing circuitry is configured to provide power to or charge the first battery of the lighting device 105 in an instance in which the lighting device 105 is situated in the receiver cavity 130 and an electrical connection is formed therebetween.

In some embodiments, the receiver cavity 130 can further include a presence sensor configured to identify a presence of the lighting device 105 in the receiver cavity, as will be described. As such, the processing circuitry of the head guard 110 can provide power to or charge the battery of the lighting device 105, for instance, in response to the presence sensor identifying the presence of the lighting device 105 relative to the head guard 110 or other dock.

In various embodiments, the lighting device 105 can further include processing circuitry configured to toggle between different modes of operation. In addition to acting as an area light and/or flashlight, the different modes of operation can include at least one of pulsating a light source of the lighting device, providing a constant light from the light source, varying the color of the light source, or varying the luminous intensity of the light source. It is understood that all or a portion of the components of the head guard 110 may be part of another type of dock, such as one affixed to a tent, sporting equipment, a vehicle, etc.

Referring now to FIG. 4, an enlarged perspective view of the head guard 110 of FIG. 1 is shown. In addition to the components described above, the head guard 110 may further include a receiver magnet 180 and a presence sensor 185. The receiver magnet 180 may be positioned in the receiver housing 120 or, more specifically, in the receiver cavity 130 such that, when the lighting device 105 is positioned in the receiver cavity 130, a magnetic coupling between a magnet of the lighting device 105 and the receiver magnet 180 is formed. As can be appreciated, the magnetic coupling retains the lighting device 105 in the receiver cavity 130 until a predetermined amount of force is applied to remove the lighting device from the receiver cavity 130. In some embodiments, the receiver magnet 180 includes an annular- or circular-shaped magnet positioned in an interior surface of the receiver housing 120. However, other shapes and sizes of receiver magnets 180 can be employed.

The receiver magnet 180 may have an outer face exposed in the receiver cavity 130. However, in alternative embodiments, the receiver magnet 180 may be disposed below a surface of the head guard 110, for instance, below a plastic surface in the receiver cavity 130, as depicted using dashed lines in FIG. 4. In other words, in some embodiments, a forward facing surface of the receiver magnet 180 is not exposed on a front face of the head guard 110. However, it is understood that one or more receiver magnets 180 may still provide sufficient magnetic force for coupling the lighting device 105 to the head guard 110. The one or more receiver magnets 180 may include annular-shaped magnets, as shown in FIG. 4, or receiver magnets 180 of other shapes positioned are various strategic positions on a front facing portion of the head guard 110.

The presence sensor 185 can include a mechanical, optical, resistance-based, or other suitable sensor for detecting a presence of the lighting device 105 in the receiver cavity 130, or a lack thereof. For instance, the presence sensor 185 can trigger a light source positioned in the receiver cavity 130 to turn on when the lighting device 105 is removed from the receiver cavity 130, or to turn off when the lighting device 105 is returned or otherwise positioned in the receiver cavity 130 based on a corresponding control circuit.

To this end, the presence sensor 185 can project from an inner surface of the receiver cavity 130 such that, when the lighting device 105 is positioned in the receiver cavity 130, a force is applied against the presence sensor 185 (e.g., causing the presence sensor 185 to retract within a body of the head guard 110) that indicates the presence of the lighting device 105. Otherwise, the presence of the lighting device 105 can be detected based on changes or resistance, impedance, capacitance, amount of light, etc. in various embodiments.

Additionally, in some embodiments, the presence sensor 185 can be formed of an electrically conductive material, such as copper or other suitable conductive material, such that the presence sensor 185 is also an electrical contact 188. As such, one or more electrical contacts positioned on a rear of the lighting device 105 can form an electrical connection with the presence sensor 185 such that the lighting device 105 can be charged using a power source electrically coupled to the head guard 110. Also, the head guard 110 may include other electrical contacts separate from the presence sensor 185 for forming an electrical connection with the lighting device 105, as may be appreciated.

Further, the lighting device base 145 of the lighting device 105 can be retained in the receiver cavity 130 such that any torque or force applied on a distal top portion or a distal bottom portion of the lighting device 105 can cause the receiver housing 120 to pivot about an axis $\alpha_1$. Notably, pivoting occurs without causing the lighting device 105 to disengage from the head guard 110. Additionally, in some embodiments, the pivoting knobs 125 can be turned by the operator in a clockwise or counter-clockwise direction, or otherwise manipulated, to pivot the receiver housing 120 and a lighting device 105 positioned therein about the axis $\alpha_1$.

Figure 5:
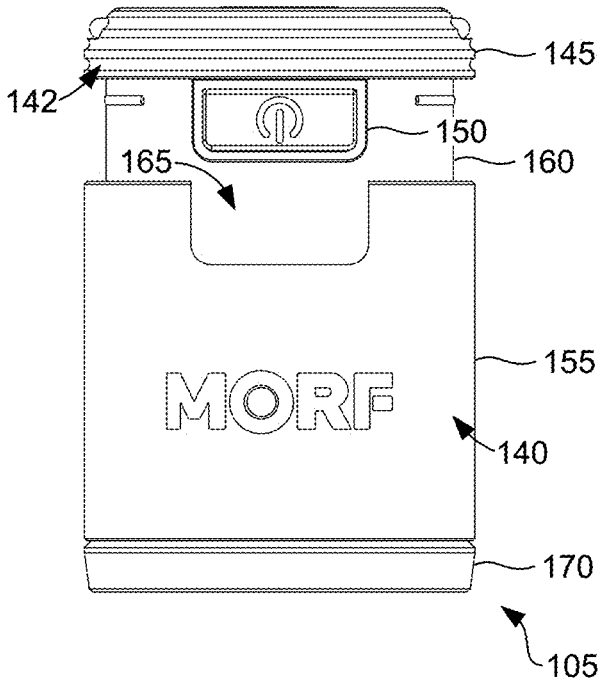
FIG. 5 is a top elevation view of the dual-mode lighting device of FIG. 1 in accordance with various embodiments of the present disclosure.
Figure 6:
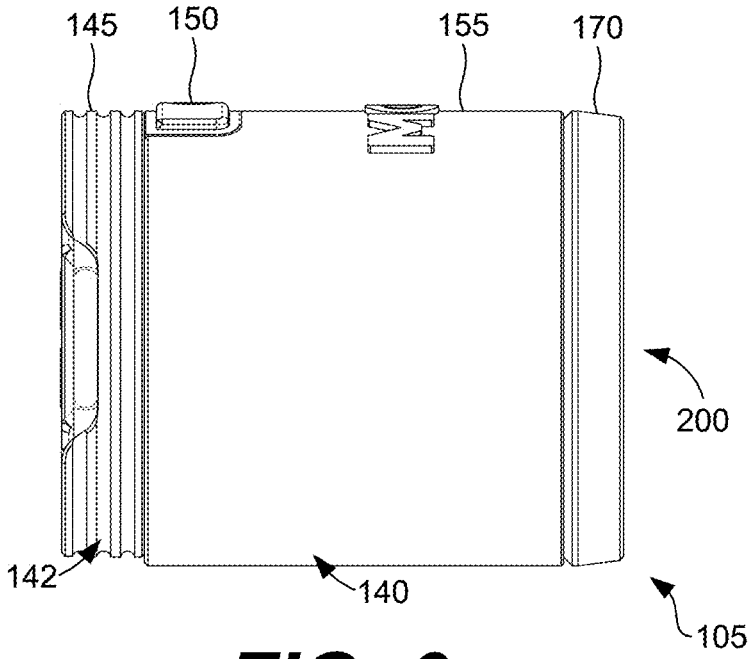
FIG. 6 is a side elevation view of the dual-mode lighting device of FIG. 1 in accordance with various embodiments of the present disclosure.

FIG. 5 shows a top elevation view of the lighting device 105 of FIG. 1 whereas FIG. 6 shows a side elevation view of the lighting device 105 in accordance with various embodiments of the present disclosure. Specifically, FIG. 5 shows the lighting device 105 with the outer sleeve 155 fully extended along the first direction $D_1$ where the lighting device 105 is toggled to an area light where light is emitted from a central region or sides of the lighting device body 140 (e.g., a second state). FIG. 6, on the other hand, shows the lighting device 105 with the outer sleeve 155 fully retracted along the second direction $D_2$ where the lighting device 105 is in a second state acting as a flashlight where light is emitted only from a front side 200 of the lighting device 105 (e.g., a first state).

Figure 7:
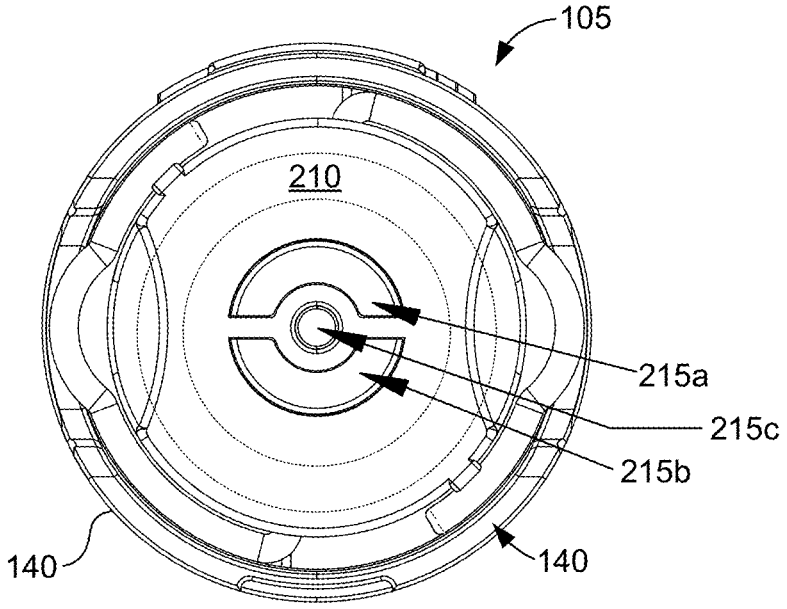
FIG. 7 is a rear view of the dual-mode lighting device of FIG. 1 in accordance with various embodiments of the present disclosure.
Figure 10:
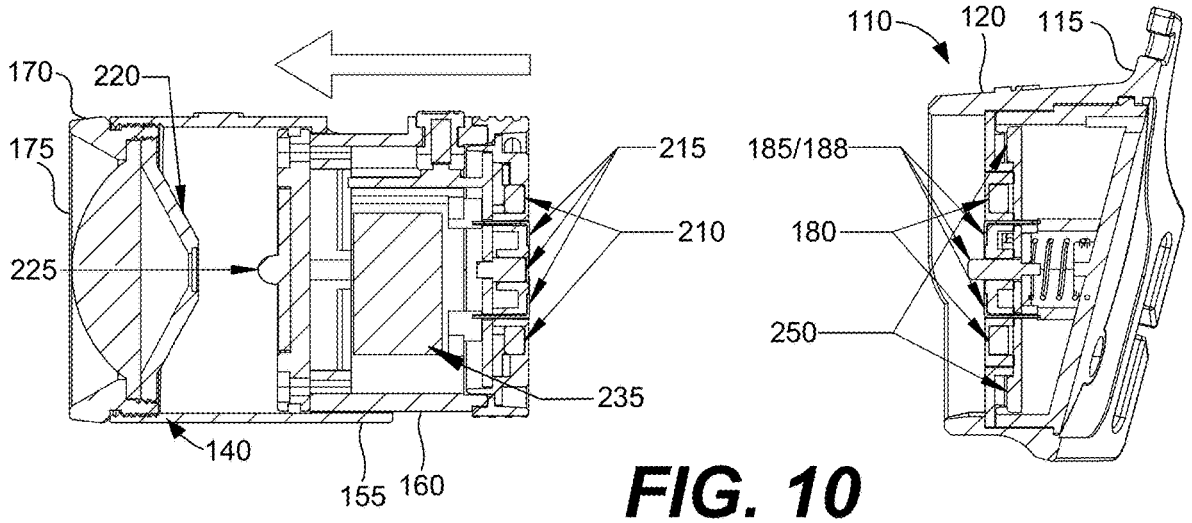
FIG. 10 is another side cross-section view of the dual-mode lighting device and the head guard of FIG. 1 in accordance with various embodiments of the present disclosure.

Turning now to FIG. 7, a rear view of the lighting device 105 is shown in accordance with various embodiments. The lighting device 105 may include one or more magnets 210 and/or one or more electrical contacts 215 positioned on a rear side of the lighting device body 140. The magnets 210 may be sized and positioned to magnetically couple to a corresponding magnet on the head guard 110 or other dock, thereby magnetically coupling the lighting device 105 to the head guard 110 or dock. For instance, the magnets 210 of the light device 105 may magnetically couple to the receiver magnet 180 shown in FIG. 4. As the magnets 210 are shown in dashed lines, the magnets 210 may be disposed below a rear surface of the lighting device body 140, for instance, below a plastic surface. In other words, in some embodiments, a surface of the magnet 210 is not exposed on the rear face of the lighting device 105. However, it is understood that the one or more magnets 210 may still provide sufficient magnetic force for coupling the lighting device 105 to the head guard 110. The one or more magnets 210 may include annular-shaped magnets, as shown in FIG. 10, or other shaped magnets 210 positioned are various strategic positions on a rear of the lighting device 105.

Figure 8:
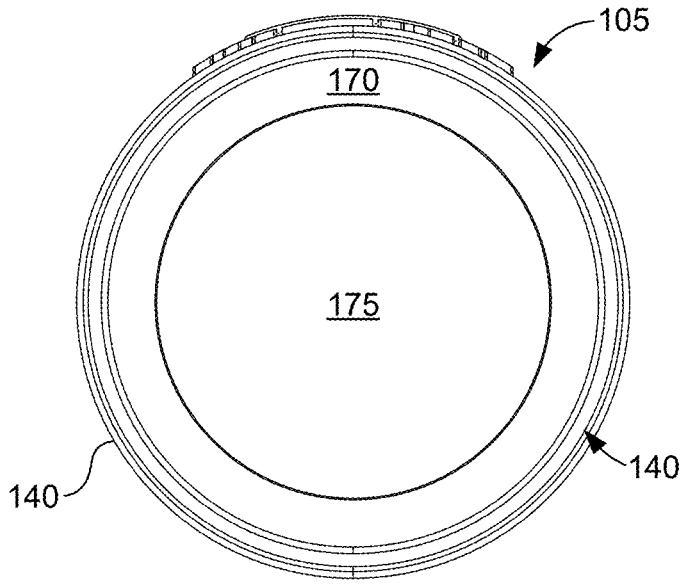
FIG. 8 is a front view of the dual-mode lighting device of FIG. 1 in accordance with various embodiments of the present disclosure.

Similarly, the electrical contact 215 may be sized and positioned to electrically couple to a corresponding electrical contact positioned in the receiver cavity 130 or otherwise positioned on the head guard 110, such as the presence sensor 185. Accordingly, the rear side of the lighting device 105 is adapted to electrically and/or magnetically couple the lighting device 105 to a dock, such as the head guard 110, for instance, when the lighting device 105 is positioned in the receiver cavity 130. A front view of the lighting device 105 is shown in FIG. 8.

In various embodiments, the electrical contacts 215 include three of the electrical contacts 215, although other suitable amount of electrical contacts 215 may be employed. In the example of FIG. 7, however, the electrical contacts 215 include a first electrical contact 215*a* having a semi-circular or arced shape, a second electrical contact 215*b* having a semi-circular or arced shape opposite that of the first electrical contact 215*a*, and a third circular electrical contact 215*c* protruding from a rear surface of the lighting device 105. The first electrical contact 215*a* can include a positive (+) terminal, the second electrical contact 215*b* can include a negative (−) terminal (or vice versa), and the third electrical contact 215*c* can include a ground terminal, respectively, in some embodiments. It is understood, however, that other shapes and arrangements of the electrical contacts 215 may be employed.

Figure 9:
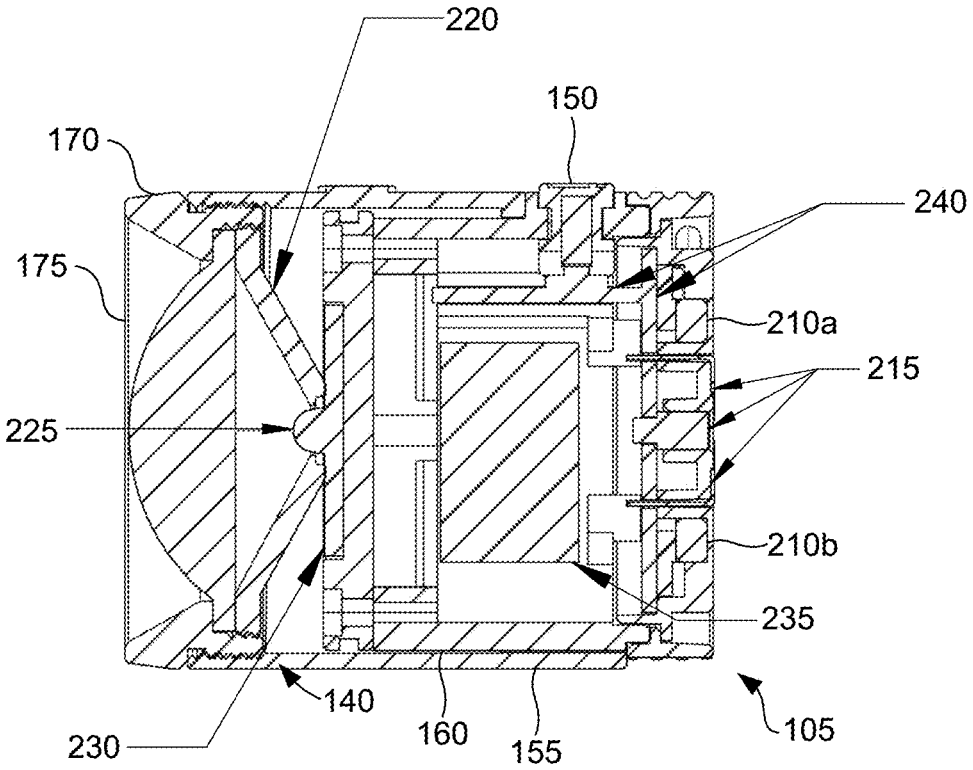
FIG. 9 is a side cross-section view of the dual-mode lighting device of FIG. 1 in accordance with various embodiments of the present disclosure.

Referring next to FIG. 9, a side cross-section view of the lighting device 105 of FIG. 1 is shown in accordance with various embodiments of the present disclosure. In the cross-section view of FIG. 9, the lighting device 105 may further include a light cup 220 and a light emitting element, such as a LED 225 or other suitable light emitting element. The lighting device 105 may further include an LED circuit board 230, a battery 235, and circuit boards 240 (e.g., printed circuit boards or PCBs). Also, the inner sleeve 160, the outer sleeve 155, the switch 150, the bezel 170, the one or more magnets 210*a*, 210*b*, the electrical contacts 215, and other components of the lighting device 105 are shown in FIG. 9. In some embodiments, the LED 225 and the LED circuit board 230 are integrally formed, meaning the LED circuit board 230 may have the LED 225 embedded on a common substrate. However, various embodiments are not limited to the foregoing.

The battery 235 may include a rechargeable battery in some embodiments. To this end, when the lighting device 105 is coupled to the head guard 110 or other suitable dock, and an electrical connection is established with the lighting device 105, and the battery 235 may be recharged. The battery 235 may include a lithium-ion, nickel-cadmium, or other suitable type of battery 235.

As noted above, the outer sleeve 155 of the lighting device 105 slides relative to the inner sleeve 160. In various embodiments, the outer sleeve 155 may include a transparent or partially transparent body allowing light to pass through. For instance, in some embodiments, the outer sleeve 155 includes a frosted diffused body, where the outer sleeve 155 is at least partially transparent. It is understood that other textures other than frosted diffusion can be employed so long as the outer sleeve 155 is at least partially transparent in accordance with some embodiments described herein.

Figure 13:
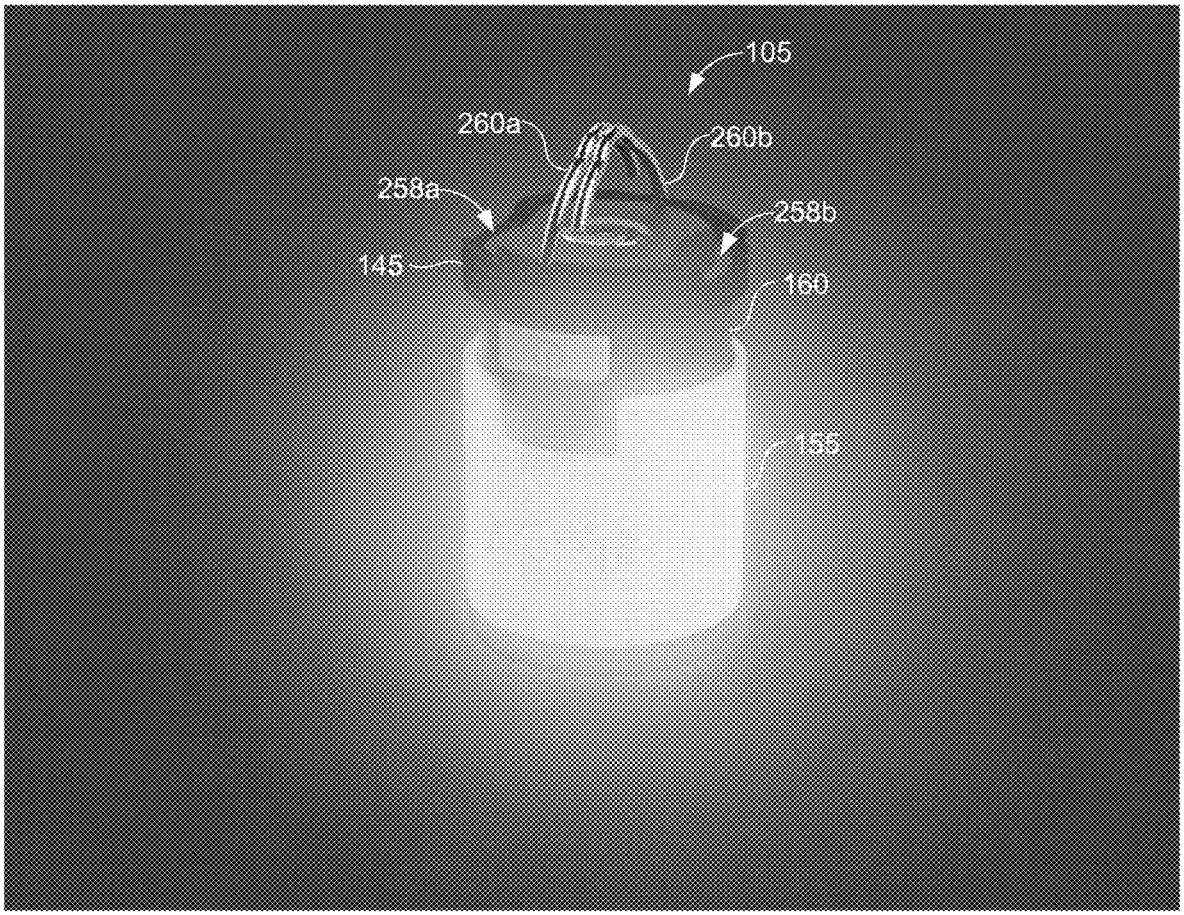
FIG. 13 is a perspective view of the dual-mode lighting device of FIG. 1 in operation in accordance with various embodiments of the present disclosure.
Figure 14:
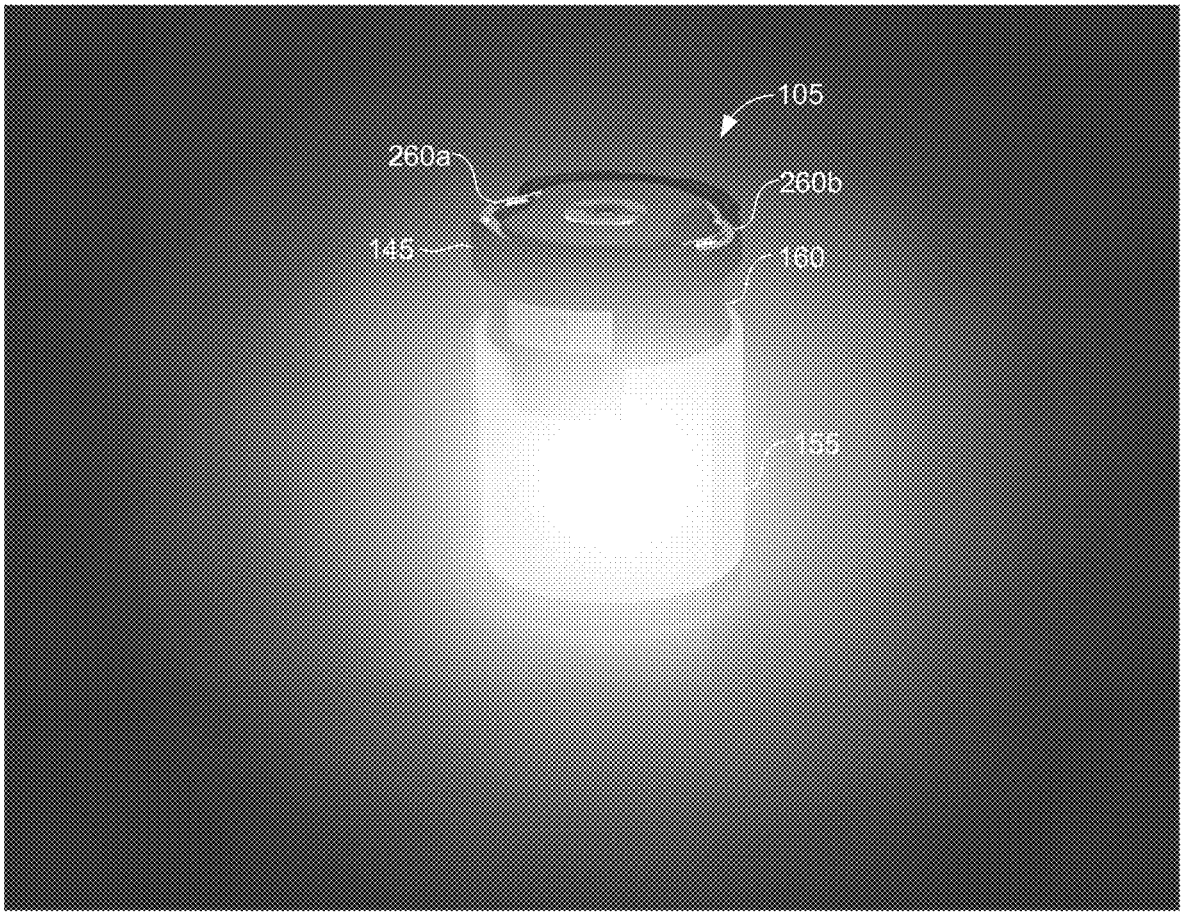
FIG. 14 is a perspective view of the dual-mode lighting device of FIG. 1 in operation in accordance with various embodiments of the present disclosure.

The inner sleeve 160, on the other hand, may be substantially opaque. When the outer sleeve 155 slides to the left side of FIG. 10, such that the outer sleeve 155 is fully extended relative to the stationary inner sleeve 160, the LED 225 separates from the light cup 220. By separating the LED 225 from the light cup 220, light emitted by the LED 225 is diffused through the frosted plastic body, thereby creating an area light, as shown in FIG. 13 and FIG. 14.

Figure 12:
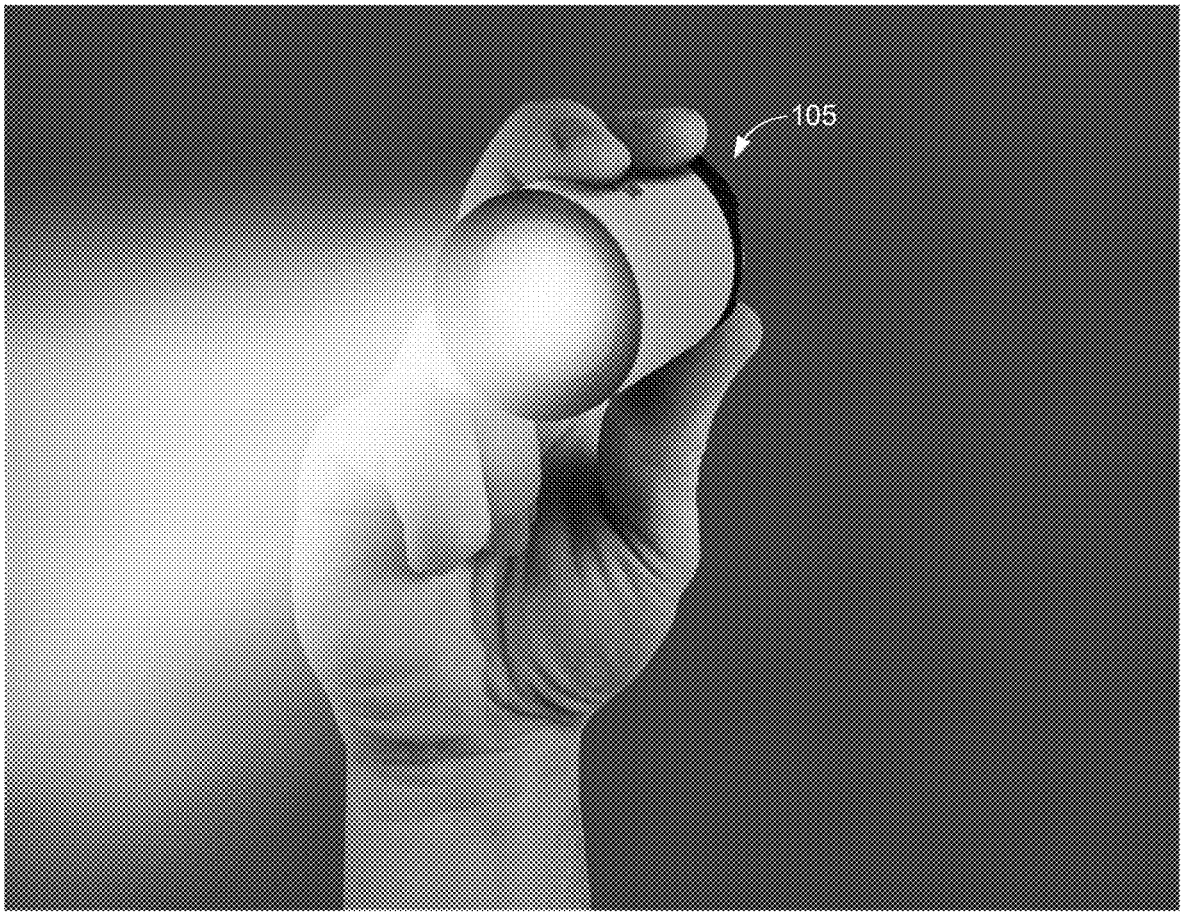
FIG. 12 is a perspective view of the dual-mode lighting device of FIG. 1 in operation in accordance with various embodiments of the present disclosure.

On the other hand, when the outer sleeve 155 slides in the second direction $D_2$ such that the outer sleeve 155 is fully retracted relative to the stationary inner sleeve 160, the LED 225 is joined with the light cup 220, as shown in FIG. 9. The joining of the light cup 220 and the LED 225 causes light emitted by the LED 225 to be diffused through the front of the lighting device 105, thereby acting as a flashlight, as shown in FIG. 12.

In other words, when the lighting device 105 is toggled to the area light mode of operation, as shown in FIG. 10, the light cup 205 is in a first position that causes the light of the LED 225 or other light emitting element to emit through sides of the outer sleeve 160, whereas, when the lighting device 105 is toggled to the flashlight mode of operation, the light cup 205 is in a second position that causes the light of the light emitting element to emit through only the front of the lighting device 105 (e.g., through the lens 175), as shown in FIG. 9. Accordingly, the light cup 220 may be coupled to or integral with the outer sleeve 155 such that the light cup 220 slides with the outer sleeve 155 relative to the inner sleeve 160.

Moving along to FIG. 10, a side cross-section view of the lighting device 105 is shown relative to a side cross-section view of the head guard 110 in accordance with various embodiments of the present disclosure. The head guard 110 can include one or more housing light emitting elements 250. In one or more embodiments, the housing light emitting elements 250 may include chip-on-board LEDs (COB LEDs), which may include a printed circuit board or similar substrate having an LED disposed integrally thereon and processing circuitry. In some embodiments, the housing light emitting elements 250 can include secondary illumination sources independent of the lighting device 105. In some embodiments, the housing light emitting elements 250 are not necessarily formed integral with or disposed on the substrate of a circuit board.

The housing light emitting elements 250 can include, for instance, one or more LEDs positioned annularly around a perimeter of a circuit board, another substrate, or in another suitable arrangement. In instances in which the housing light emitting elements 250 are COB LEDs, the circuit board of the housing light emitting elements 250 may comprise processing circuitry configured to turn on one or more housing light emitting elements 250 or other housing housing light emitting elements 250 when the lighting device 105 is removed from the receiver cavity 130, and turn off the housing light emitting elements 250 when the lighting device 105 is inserted into the receiver cavity 130 or otherwise coupled to the head guard 110. It is understood that the presence, or lack thereof, of the lighting device 105 can be detected by the presence sensor 185. Accordingly, the head guard 110 can provide light independent of the lighting device 105 in some embodiments.

In various embodiments, the receiver cavity 130 of the head guard 110 may include a first electrical contact 188 and a first magnet 180 positioned therein. The lighting device 105 may be adapted to be positioned in the receiver cavity 130 of the head guard 110, where the lighting device 105 includes a second electrical contact 215 and a second magnet 210. The lighting device 105 may be sized and positioned such that, when positioned in the receiver cavity 130, the second magnet 210 of the lighting device 105 magnetically couples to the first magnet 180 of the head guard 110, and the second electrical contact 215 of the lighting device 105 electrically couples to the first electrical contact 188 of the head guard 110 positioned, for example, in the receiver cavity 130.

Figure 11:
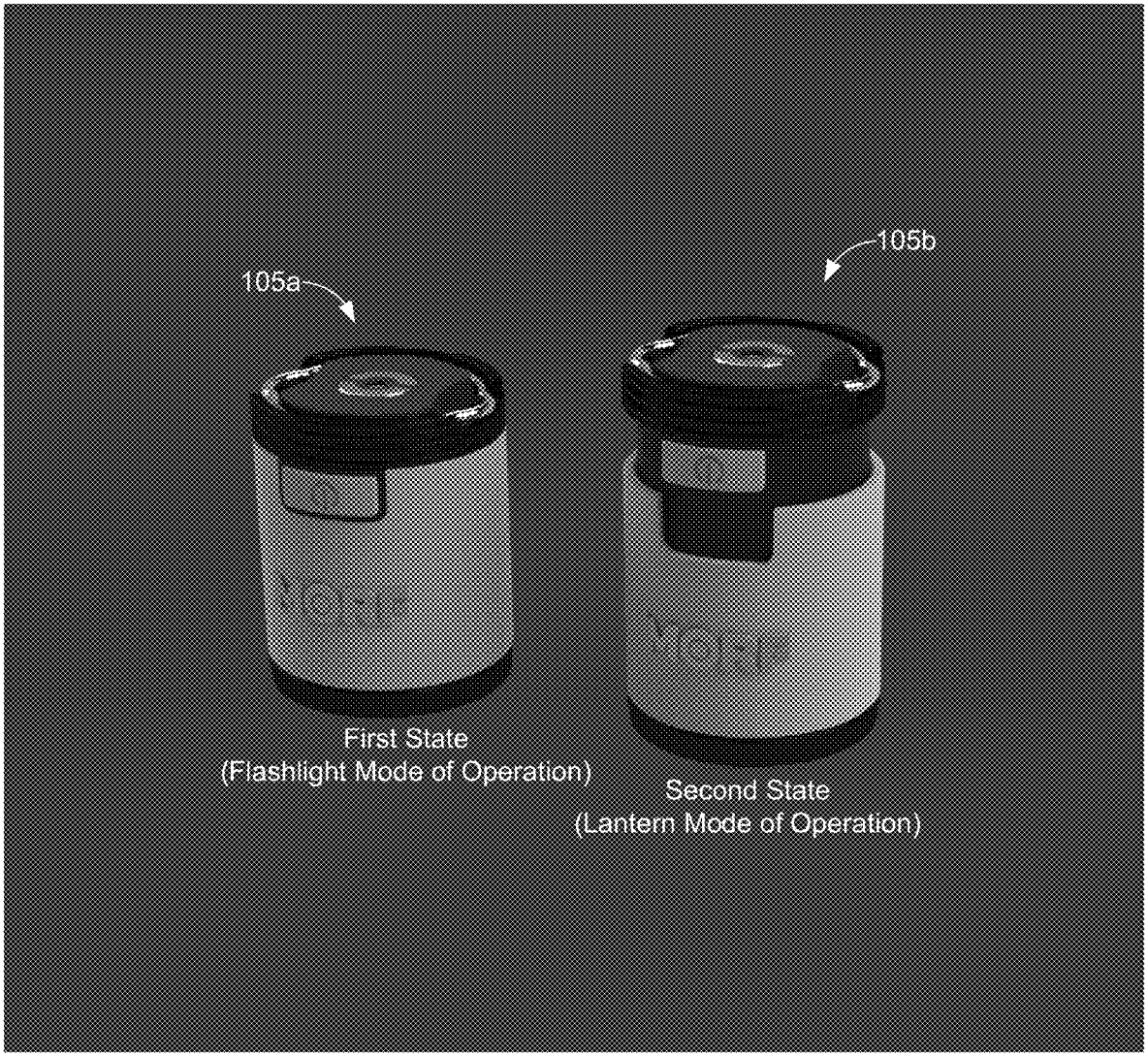
FIG. 11 is a perspective view of the dual-mode lighting device of FIG. 1 in a first state and a second state in accordance with various embodiments of the present disclosure.

FIG. 11 is a perspective view of the lighting devices 105*a*, 105*b* shown in a first state and a second state, respectively, in accordance with various embodiments of the present disclosure. More specifically, the first lighting device 105*a* is shown in a first state or mode of operation, where the first lighting device 105*a* can be used as a flashlight. Conversely, the second lighting device 105*b* is shown in a second state or mode of operation, where the second lighting device 105*b* can be used as an area light or lantern. Accordingly, the lighting device 105 described herein can be referred to as a dual-mode or multi-mode lighting device 105 in various embodiments.

FIG. 12 is a perspective view of the lighting device 105 in the first mode of operation, where the lighting device 105 is used as a flashlight. On the other hand, FIG. 13 and FIG. 14 are perspective views of the lighting device 105 in the second mode of operation, where the lighting device 105 is configured to act as a lantern or area light. Notably, light is shown being emitted through the outer sleeve 155, which is partially transparent.

At least a portion of the body of the lighting device 105, such as the outer sleeve 155, may include a frosted body housing. The frosted body housing may be fully or partially transparent. In some embodiments, a rear side of the lighting device body 140 or, more specifically, the lighting device base 145 may include a first recess 258*a* and a second recess 258*b*. A first hook 260*a* and a second hook 260*b* may be pivotably coupled to the lighting device base 145 such that the first hook 260*a* can be removably positioned within the first recess 258*a* and a second hook 260*b* can be removably positioned within the second recess 258*b*. In other embodiments, the light device base 145 may include a center piece that surrounds the lighting device base 145 having a diameter, for instance, greater than the lighting device base 145. In this embodiment, the first hook 260*a* and the second hook 260*b* may be pivotably coupled to the center piece, as opposed to the lighting device base 145 such that the first hook 260*a* can be removably positioned within the first recess 258*a*, and the second hook 260*b* can be removably positioned within the second recess 258*b*.

The first hook 260*a* and the second hook 260*b* can include semi-circular hooks and the first aperture 258*a* and the second aperture 258*b* can include semi-circular apertures in some examples. For instance, the lighting device 105 may include a first semi-circular hook 260*a* and a second semi-circular hook 260*b* that are pivotably connected to the lighting device base 145 such that the semi-circular hooks 260 can be nested in an aperture of the lighting device base 145 (e.g., an annular aperture) or pulled outwards to hang the lighting device 105 from a tree, tent, hook, or other suitable apparatus.

In some embodiments, the foldable and semi-circular hooks 260 can be formed of a magnetic material such that the semi-circular hooks 260 contact a corresponding magnet (not shown) of the head guard 110 or other dock, creating or increasing a magnetic connection with the head guard 110 or other dock. It is understood that the semi-circular recesses 258 and the semi-circular hooks 260 may assume other shapes other than a semi-circular shape as desired. FIG. 13 shows the hooks 260 in a hanging mode of operation, whereas FIG. 14 shows the hooks 260 nested in the lighting device base 145.

Figure 15:
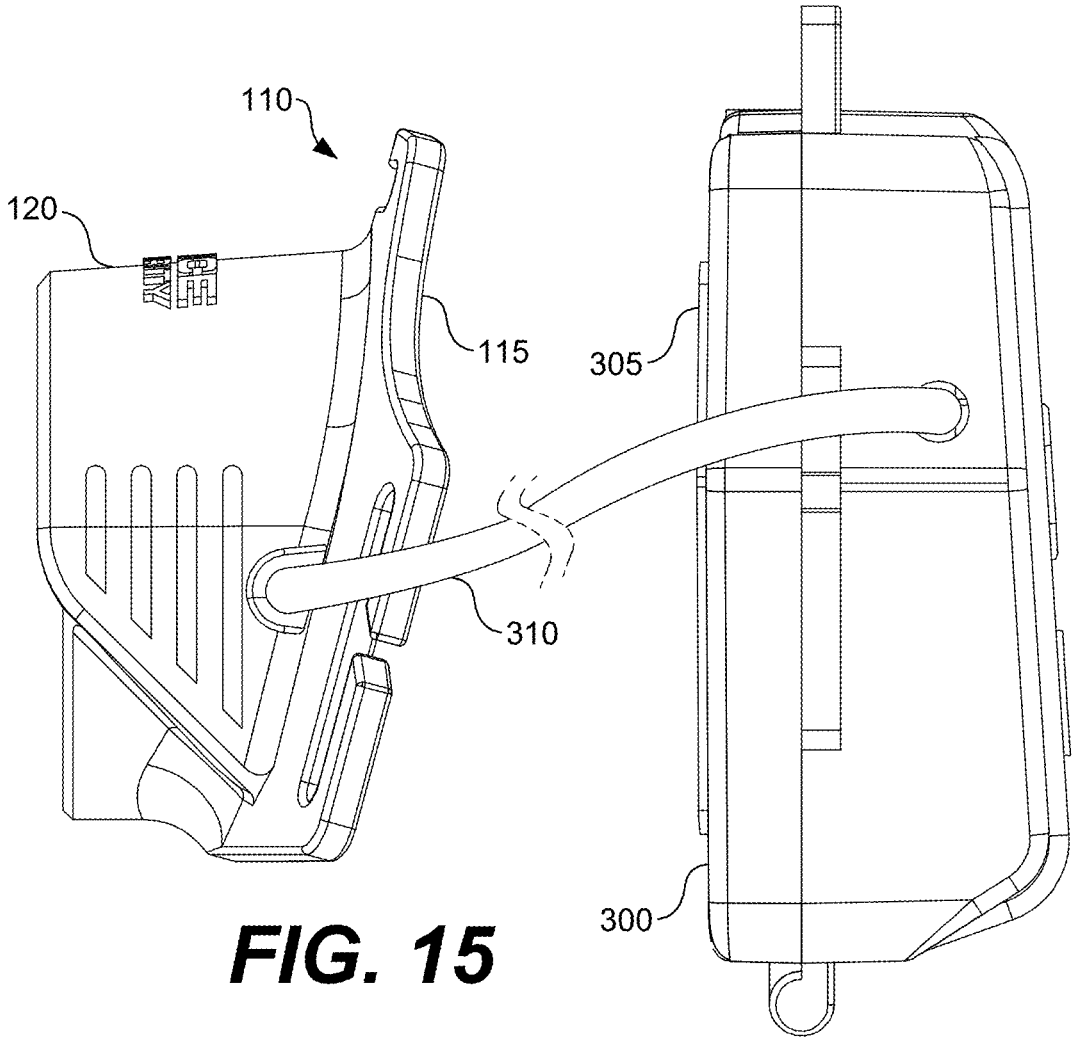
FIG. 15 is a side view of the head guard of FIG. 1 shown relative to a power supply in accordance with various embodiments of the present disclosure.

Moving along to FIG. 15, a side view of the head guard 110 is shown being electrically coupled to a power supply housing 300 in accordance with various embodiments of the present disclosure. As noted above, the head guard 110 may be positioned on a forehead, or a front portion of a helmet or hat of an operator. In some embodiments, the power supply housing 300 can be positioned on a rear portion of a head or a helmet of an operator via a rear head guard 305. As can be appreciated, the head guard 110 and the rear head guard 305 can be coupled to one another via one or more straps, which are not shown for explanatory purposes.

The power supply housing 300 can include one or more batteries stored therein. The power source can thus power circuitry of the head guard 110 as well as directly power the LED 225 and circuitry of the lighting device 105 (bypassing the battery of the lighting device 105), for instance, when the lighting device 105 is positioned in the receiver cavity 130. Additionally, the batteries of the power supply housing 300 can be employed to recharge the battery 235 of the lighting device 105. In some embodiments, the power source of the power supply housing 190 is electrically coupled to the head guard 110 via a wire 310 or other suitable electrical connection mechanism. As such, a power source in the power supply housing 300 can be described as being electrically coupled to the circuit board of the head guard 110, as shown in FIG. 10.

The power supply housing 300 may include a power button (not shown) that toggles the lighting device 105, for instance, when the lighting device 105 is attached to the head guard 110. Also, the power button may control operation (e.g., on, off, pulse, etc.) of the housing light emitting elements 250, for instance, when the lighting device 105 is removed and not coupled to the head guard 110.

Although relative terms are used in this specification, such as "up" and "down" to describe the relative relationship between one component and another component of an icon, these terms are used in this specification for convenience only, for example according to the directions of the examples described in the drawings. It can be understood that if the device is turned upside down, the component described "up" will become the component "down." When a structure is "on" or "positioned on" another structure, it may mean that a structure is integrally formed on another structure, or that a structure is "directly" arranged on another structure, or that a structure is arranged "indirectly" on another structure through another structure.

The terms "a," "an," "the," and "said" are used to indicate that there are one or more elements, components, etc. The terms "comprising" and "having" are used to indicate open-ended inclusion, and refers to that, in addition to the listed elements, components, etc., there may be other elements, components, etc. The terms "first," "second," etc. are used only as labels, and are not intended to be a limitation on the number of objects. It is understood that if the specification described a plurality of components, individual ones of the components can be referred to as a first component, a second component, and so forth.

It should be emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

Therefore, the following is claimed:

1. A system, comprising:

a head guard comprising a first power source;

a lighting device configured to detachably attach to the head guard, the lighting device comprising:

a second power source different from the first power source;

a light emitting element; and a lighting device body comprising an inner sleeve and an outer sleeve, wherein the outer sleeve is adapted to slide relative to the inner sleeve along the light device body to toggle the lighting device between (a) an area light mode of operation where light of the light emitting element emits from sides of the lighting device body; and (b) a flashlight mode of operation where light of the light emitting element emits only from a front of the lighting device; and wherein the head guard further comprises processing circuitry configured to, when the lighting device is detachably attached to the head guard, use the first power source to provide power to or charge the second power source.

2. The system of claim 1, wherein:

the head guard comprises at least one magnet and at least one electrical contact;

the lighting device comprises at least one magnet and at least one electrical contact; and the lighting device is sized and positioned such that, when removably attached to the head guard, the at least one magnet of the lighting device magnetically couples to the at least one magnet of the head guard and the at least one electrical contact of the lighting device electrically couples to the at least one electrical contact of the head guard.

3. The system of claim 1, wherein:

the outer sleeve is at least partially transparent and the inner sleeve is opaque;

the lighting device comprises a light cup secured to the outer sleeve such that the light cup slides with the outer sleeve relative to the inner sleeve;

when the lighting device is toggled to the area light mode of operation, the light cup is in a first position that causes the light of the light emitting element to emit through sides of the outer sleeve; and when the lighting device is toggled to the flashlight mode of operation, the light cup is in a second position that causes the light of the light emitting element to emit through only the front of the lighting device.

4. The system of claim 1, wherein:

the head guard comprises a receiver cavity, a presence sensor positioned within the receiver cavity, a housing light emitting element, and processing circuitry; and the processing circuitry is configured to turn on the housing light emitting element when the lighting device is removed from the receiver cavity and turn off the housing light emitting element when the lighting device is positioned in the receiver cavity.

5. The system of claim 1, wherein the lighting device body further comprises:

a lighting device base comprising a first recess positioned on a first side of the lighting device base and a second recess positioned on a second side of the lighting device base;

a first hook pivotably coupled to the lighting device base such that a pivot of the first hook nests the first hook in the first recess or retracts the first hook from the first recess; and a second hook pivotably coupled to the lighting device base such that a pivot of the second hook nests the second hook in the second recess or retracts the second hook from the second recess.

6. The system of claim 5, wherein the first recess, the second recess, the first hook, and the second hook are semi-circular shaped.

7. The system of claim 1, wherein the lighting device further comprises a switch and processing circuitry that is configured to toggle the lighting element disposed within the lighting device body between a plurality of modes of illumination in response to a manipulation of the switch.

8. The system of claim 1, wherein:

the first power source is at least one first rechargeable battery; and the second power source is at least one second rechargeable battery.

9. The system of claim 1, wherein:

the head guard comprises a receiver cavity; and the lighting device comprises a lighting device base of a shape and size similar to the receiver cavity such that the lighting device forms an interference fit with the receiver cavity.

10. The system of claim 1, wherein:

the outer sleeve comprises an aperture;

the lighting device comprises a switch projecting from the inner sleeve of the lighting device body, the aperture and the switch having a similar size and shape; and when the lighting device is toggled to the flashlight mode of operation, the switch is nested within the aperture.

11. A system, comprising:

a lighting device configured to detachably attach to a dock, the lighting device comprising:

a battery;

a light emitting element;

a lighting device body comprising an inner sleeve and an outer sleeve, the outer sleeve comprising an aperture; and a switch projecting from the inner sleeve of the lighting device body, wherein the aperture and the switch have a similar size and shape;

wherein the outer sleeve is adapted to slide relative to the inner sleeve along the light device body to toggle the lighting device between (a) an area light mode of operation where light of the light emitting element emits from sides of the lighting device body; and (b) a flashlight mode of operation where light of the light emitting element emits only from a front of the lighting device; and wherein, when the lighting device is toggled to the flashlight mode of operation, the switch is nested within the aperture.

12. The system of claim 11, wherein:

the system comprises the dock, wherein the dock is a head guard comprising at least one magnet and at least one electrical contact;

the lighting device comprises at least one magnet and at least one electrical contact; and the lighting device is sized and positioned such that, when removably attached to the head guard, the at least one magnet of the lighting device magnetically couples to the at least one magnet of the head guard and the at least one electrical contact of the lighting device electrically couples to the at least one electrical contact of the head guard.

13. The system of claim 11, wherein:

the outer sleeve is at least partially transparent and the inner sleeve is opaque;

the lighting device comprises a light cup secured to the outer sleeve such that the light cup slides with the outer sleeve relative to the inner sleeve;

when the lighting device is toggled to the area light mode of operation, the light cup is in a first position that causes the light of the light emitting element to emit through sides of the outer sleeve; and when the lighting device is toggled to the flashlight mode of operation, the light cup is in a second position that causes the light of the light emitting element to emit through only the front of the lighting device.

14. The system of claim 11, wherein:

the system comprises the dock, wherein the dock is a head guard comprising a receiver cavity, a presence sensor positioned within the receiver cavity, a housing light emitting element, and processing circuitry; and the processing circuitry is configured to turn on the housing light emitting element when the lighting device is removed from the receiver cavity and turn off the housing light emitting element when the lighting device is positioned in the receiver cavity.

15. The system of claim 11, wherein the lighting device body further comprises:

a lighting device base comprising a first recess positioned on a first side of the lighting device base and a second recess positioned on a second side of the lighting device base;

a first hook pivotably coupled to the lighting device base such that a pivot of the first hook nests the first hook in the first recess or retracts the first hook from the first recess; and a second hook pivotably coupled to the lighting device base such that a pivot of the second hook nests the second hook in the second recess or retracts the second hook from the second recess.

16. The system of claim 15, wherein the first recess, the second recess, the first hook, and the second hook are semi-circular shaped.

17. The system of claim 11, wherein the lighting device further comprises processing circuitry that is configured to toggle the lighting element disposed within the lighting device body between a plurality of modes of illumination in response to a manipulation of the switch.

18. The system of claim 11, wherein:

the system comprises the dock;

the battery of the lighting device is rechargeable; and the dock comprises processing circuitry configured to, in response to the lighting device being electrically coupled to the head guard, recharge the battery of the lighting device.

19. The system of claim 11, wherein:

the system comprises the dock, wherein the dock comprises a receiver cavity; and the lighting device comprises a lighting device base of a shape and size similar to the receiver cavity such that the lighting device forms an interference fit with the receiver cavity.

20. A method, comprising:

providing a head guard, wherein the head guard comprises a presence sensor, a housing light emitting element, and processing circuitry; and providing a lighting device configured to detachably attach to the head guard, the lighting device comprising:

a battery;

a light emitting element; and a lighting device body comprising an inner sleeve and an outer sleeve, wherein the outer sleeve is adapted to slide relative to the inner sleeve along the light device body to toggle the lighting device between (a) an area light mode of operation where light of the light emitting element emits from sides of the lighting device body; and (b) a flashlight mode of operation where light of the light emitting element emits only from a front of the lighting device;

wherein the processing circuitry of the head guard is configured to turn on the housing light emitting element when the light emitting device is detached from the head guard and turn off the housing light emitting element when the light emitting device is attached to the head guard.

* * * * *